United States Patent [19]

Rogers

[11] 4,294,385

[45] Oct. 13, 1981

[54] RAPIDLY SEPARABLE HOLSTER AND HOLSTER-CARRYING BELT

[75] Inventor: William H. Rogers, Jacksonville, Fla.

[73] Assignee: Alpha Plastics, Inc., Jacksonville, Fla.

[21] Appl. No.: 124,658

[22] Filed: Feb. 25, 1980

[51] Int. Cl.[3] ..... F41C 33/02; F41B 13/04

[52] U.S. Cl. ..... 224/240; 224/182; 224/192; 224/252; 224/253

[58] Field of Search ..... 224/240, 192, 206, 216, 224/226, 252, 269, 271, 182, 195, 207, 253, 272; 24/201 A, 245 R, 247

[56] References Cited

U.S. PATENT DOCUMENTS

| | | | |
|---|---|---|---|
| 1,222,264 | 4/1917 | Cabanne | 224/271 |
| 2,609,979 | 9/1952 | Spann | 224/206 |
| 3,115,997 | 12/1963 | Hengst | 224/253 X |
| 3,400,435 | 9/1968 | Äkesson-Rydin | 24/247 |
| 3,408,708 | 11/1968 | Hawie | 24/245 R |
| 4,068,784 | 1/1978 | Angell | 224/206 X |
| 4,235,356 | 11/1980 | Atchisson | 224/192 |

*Primary Examiner*—Steven M. Pollard
*Attorney, Agent, or Firm*—Arthur G. Yeager

[57] ABSTRACT

A combination holster and belt in which the holster is rapidly attachable to or separable from the belt comprising a holster with two spaced understanding pins on the side of the holster next to the body of the person wearing the holster, each pin comprising a shank and a generally flat head of substantial larger diameter than the diameter of the shank; and a belt having affixed on the inside surface thereof two rigid slotted plates spaced apart substantially the same distance as the distance between said pins, each of the plates and the adjacent portion of the belt being perforated with a slot, one end of which is large enough to admit the flat head of said pin and the other end of which is smaller in diameter than the head and yet large enough to admit the shank of said pin.

13 Claims, 4 Drawing Figures

RAPIDLY SEPARABLE HOLSTER AND HOLSTER-CARRYING BELT

BACKGROUND OF THE INVENTION

This invention relates to a belt and a holster for a sidearm which is easily and rapidly attached to the belt or detached therefrom without the necessity of having to unloosen the belt and remove it from the belt loops of the clothing of the person wearing the belt.

It is well known that holsters for side arms are normally designed with a loop for supporting the holster from a belt worn around the waist of the person carrying the sidearm. In most instances the belt is strung through belt loops in the coat or trousers to which the belt is attached, and in order to attach the holster it is necessary to unstring the belt through sufficient number of belt loops to reach the position where the holster will be carried and then to string the belt through the holster loop and through the unstrung belt loops before the belt can be buckled again. The reverse operation is of course necessary when the holster is to be removed from the belt. This operation is especially true in the case of holsters which are worn beneath a jacket and carried on the trouser belt. One type of such a holster is described and claimed in my copending patent application Ser. No. 954,351 filed Oct. 25, 1978.

One type of holster that is attachable to the belt of the user without the necessity of unstringing the belt is shown in my patent U.S. Pat. No. 3,902,639. While this patented holster is desirable for many purposes, it is not particularly applicable to a leather holster. It is an object of the present invention to provide a means of attaching a holster which may or may not be leather, to a trousers belt without requiring the belt to be removed from the belt loops of the trousers.

BRIEF SUMMARY OF THE INVENTION

This invention provides a rapidly separable holster and holster-carrying belt comprising a holster with two spaced upstanding pins on the side of the holster next to the body of the person wearing the holster, said pins comprising a shank and the generally flat head of substantially larger diameter than the diameter of said shank; and a belt having affixed on the inside surface thereof two rigid slotted plates apart substantially the same distance as the distance between said pins, each of said plates and the portion of the belt contiguous to said plate being perforated with a slot, one end of which is slightly larger than the diameter of said head and the other end of which has a diameter larger than the diameter of said shank and smaller than the diameter of said head, said slots being oriented with the lengthwise axis of the slot substantially parallel to the lengthwise axis of the belt and with the distance between the smaller ends of the slots being less than the distance between the larger ends of the slots. In a specific embodiment of this invention involving a holster made of two pieces of leather attached to each other the pins are attached to the forward and the rearward portions of the holster respectively by means of a flat head threaded stud being attached between the two pieces of leather and projecting outwardly through the inside piece of leather and being capped with a hollow internally threaded shank having a substantially flat head. In another embodiment of this invention the belt contains two spaced metallic plates riveted to the inside surface of the belt and with a slot piercing both the plate and the adjacent portion of the belt, one end of the slot being slightly larger in diameter than the diameter of the flat head of the pin on the holster and the other end of the slot being slightly larger than the shank of that pin. Other objects will appear from the more detailed description of this invention which follows.

BRIEF DESCRIPTION OF THE DRAWINGS

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
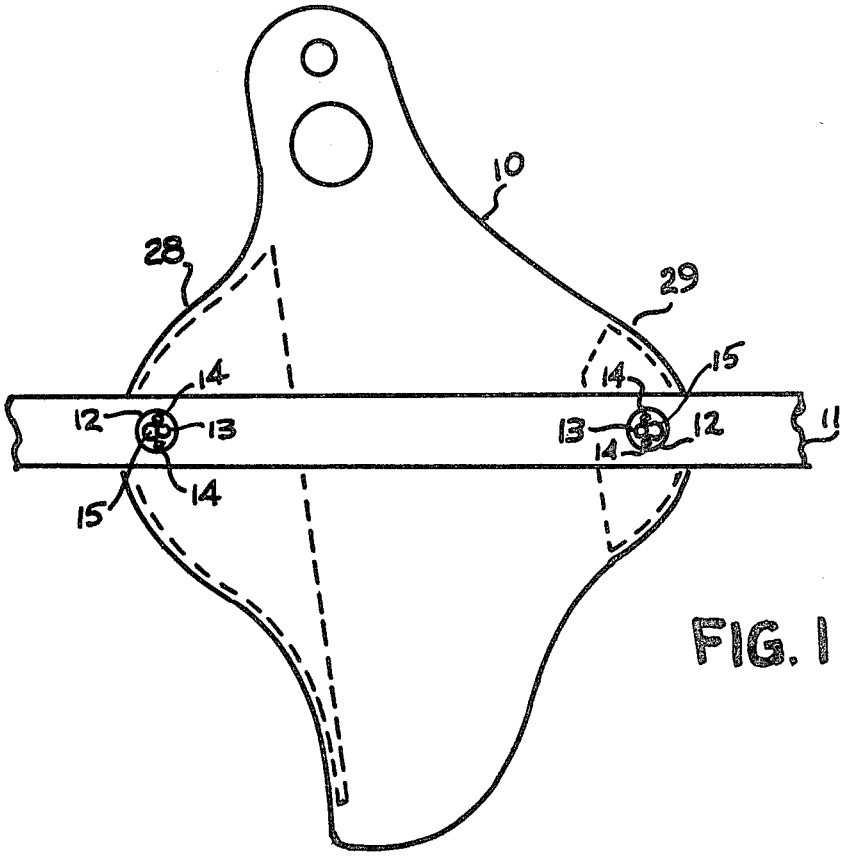
FIG. 1 is a schematic illustration of the holster and holster-carrying belt attached to each other.
Figure 2:
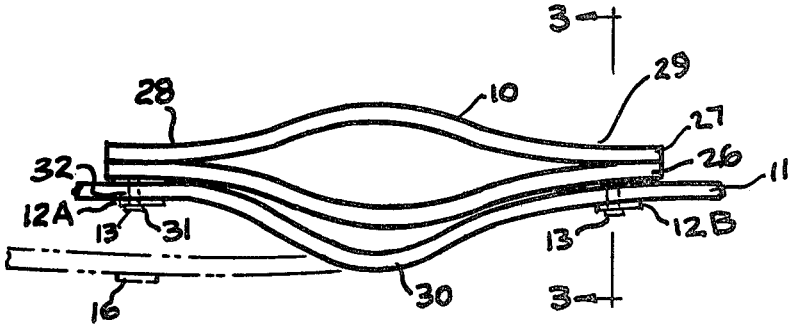
FIG. 2 is a top view of the holster and holster-carrying belt of this invention showing how the holster is removed from the belt.

By reference to FIGS. 1 and 2 the general features of this invention may be readily understood. Holster 10 is attached to belt 11 which is worn around the waist of the person carrying the holster. This view shows the inside surface of the belt and the holster which would be adjacent the person wearing these items. Holster 10 is generally made of two pieces of leather, the inside piece 26 and the outside piece 27 which are normally fastened to each other along the peripheral portions of the forward end 28 of the holster and the rearward end 29 of the holster. In the holster shown here the method of attaching these two pieces of leather 26 and 27 is by stitching although any other method is equally suitable. In each of the forward end 28 and the rearward end 29 there is affixed to the holster a pin 13 which serves as the means for attachment to belt 11. The attachment to belt 11 is accomplished by means of two spaced keeper plates 12 containing slots 15 which are sized to cooperate with the head and the shank portions of pin 13. It may be seen in FIG. 2 that plates 12 are preferably attached to the inside surface of belt 11 and thus permitting holster 10 to be attached to the outside of the belt.

Figure 4:
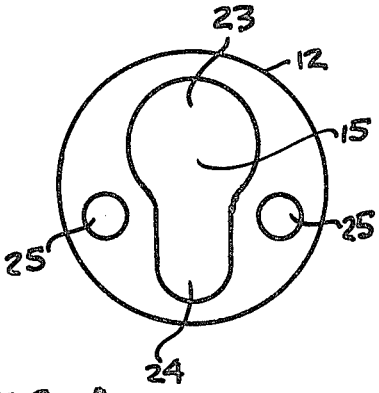
FIG. 4 is a plan view of the plate attached to the belt in this invention.

The shape of plate 12 and slot 15 may be seen in FIG. 4. Plate 12 is metal, plastic, or other light weight material of sufficient thickness to be stiff and not readily bent, a preferred material being nylon. Slot 15 is a perforation through plate 12 and belt 11 in the general shape of a keyhole with a large diameter end 23 and a small diameter end 24. Large diameter end 23 is slightly larger than the head of pin 13 and small diameter end 24 is slightly larger than the diameter of the shank of pin 13. This permits the head of pin 13 to be inserted through larger diameter end 23 and moved toward small diameter end 24 which will receive the shank of pin 13 but is too small to permit the passage of the head of pin 13. Holes 25 are incorporated to permit flat head rivets to be used for attaching plate 12 to belt 11 and to provide the least protuberance which would cause discomfort to the person wearing the holster and belt.

Plate 12 can be attached to the outside of belt 11, but it is preferable to attach it to the inside so as to provide as little obstruction as possible when stringing the belt through the belt loops of trousers. Furthermore the arrangement provides a leather-to-leather contact between the holster and belt which prevents marring and scuffing of the holster.

With the specific shape of plate 12 in mind, it may be seen in FIG. 1 that plates 12 are oriented in such a fashion that the lengthwise axis of slot 15 is substantially parallel to the lengthwise axis of belt 11 and the two plates 12 are positioned such that the small ends 24 are directed toward each other while the large ends 23 are directed away from each other. In other words the distance between the small ends 24 of the two plates 12 is less than the distance between the large ends 23 of the two plates 12. In this orientation it may be seen that belt 11 may be stretched from the two ends beyond plates 12 and force small ends 24 to encircle the shank of pins 13 and thus form a positive attachment of holster 10 to belt 11.

In FIG. 2 the ease with which holster 10 may be separated from belt 11 may be understood. All that is necessary is to move belt 11 axially to permit the head of one of pins 13 to pass through large end 23 of the respective plate 12. If the belt 11 is worn sufficiently loose there will be enough slack in the belt to permit this movement, but if the belt is worn sufficiently tight it would be necessary to unbuckle the belt to provide the small amount of movement necessary to detach holster 10. In no event would it be necessary to move the belt far enough to detach it from one or more belt loops of the trousers of the person wearing the holster. In FIG. 2 it may be seen that by moving belt 11 to provide the looseness or slack as shown at 30 plate 12A is moved to the right as shown in this drawing and thus to the position where the head 31 of pin 13 is opposite large end 23 of slot 15 while at the same time plate 12B is not changed from its position shown in FIG. 1. Belt 11 and plate 12A can then be moved from attachment with pin 13 to the position shown at 16. Of course, as soon as one end of holster 10 is detached from belt 11 the other end is readily detached by identical motions.

Figure 3:
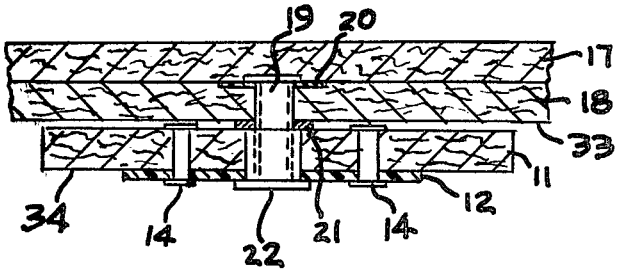
FIG. 3 is a cross sectional view taken along line 3—3 of FIG. 2.

In FIG. 3 the details of a preferred embodiment for forming the components of this invention may be seen. Holster 10 is made of two pieces of leather joined together. Outside leather portion 17 and inside leather portion 18 are stitched together or otherwise joined with flat head stud 19 and stud support 20 in the form of a washer between the two leather portions 17 and 18. Preferably stud support 20 is a thin plastic sheet so as to provide the least thickness with the required toughness. This permits the threaded portion of stud 19 to project upwardly beyond the outside surface 33 of inside leather portion 18. In order to complete the construction of pin 13 a hollow internally threaded cap 22 is screwed onto the projecting portion of stud 19 to provide the flat head and shank of pin 13 as described above. Preferably metallic washer 21 is included on the outside surface 33 around stud 19 to serve as a solid seat for cap 22. It is also preferred that cap 22 be locked onto the threaded portion of stud 19 and this may be accomplished by any of several means although it is preferred to employ a rigid setting cement or glue applied to the mating portions of the threads between cap 22 and stud 19. An epoxy cement is suitable for this purpose. Plate 12 is attached to the inside surface 34 of belt 11 by any convenient means, preferably by flat head rivets 14 which provide the least protuberance that might cause discomfort to the wearer of this belt.

The embodiments described above are preferred, but it is to be understood that there are other combinations and arrangements which also are suitable. For, example, plate 12 may be made of a aluminum, brass, or a plastic other than nylon. Furthermore, it is operable for plate 12 to be attached either on the inside or outside of belt 11. Additionally, holster 10 need not be made of leather; it may be made of plastic, a laminate of plastic and leather, or a similar material. If the holster is made of plastic or of a laminate of plastic and leather which is sufficiently stiff, it is entirely possible that stud support 20 would not be needed.

While the invention has been described with respect to certain specfic embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what is desired to secure by Letters Patent of the United States is:

1. A rapidly separable holster and holster-carrying belt comprising a holster with two spaced upstanding pins on the side of the holster next to the body of the person wearing the holster, said pins comprising a shank and a generally flat head of substantially larger diameter than the diameter of said shank; and a belt having on the inside surface thereof two rigid slotted plates spaced apart substantially the same distance as the distance between said pins, each of said plates and the contiguous portion of the belt being perforated with a slot, one end of which is slightly larger than the diameter of said head and the other end of which has a diameter larger than the diameter of said shank and smaller than the diameter of said head, said slots being oriented with the lengthwise axis of the slot substantially parallel to the lengthwise axis of the belt and with the distance between the smaller ends of the slots being less than the distance between the larger ends of the slots.

2. The holster and holster-carrying belt of claim 1 wherein said holster comprises an inside piece of leather and an outside piece of leather attached to each other around their forward and rearward peripheries with a central interior space between said pieces of leather to admit and hold a sidearm.

3. The holster and holster-carrying belt of claim 2 wherein one of said pins is attached to the forward portion of the holster and the other of said pins is attached to the rearward portion of the holster.

4. The holster and holster-carrying belt of claim 3 wherein each pin comprises a flat head threaded stud inserted through a thin stiff washer with both said flat head and said washer being mounted between said inside and outside pieces of leather and with the threaded portion of said stud projecting outwardly from the outside surface of said inside piece of leather, said threaded portion being capped by a hollow internally threaded shank having a substantially flat head.

5. The holster and holster-carrying belt of claim 4 wherein said thin stiff washer is plastic.

6. The holster and holster-carrying belt of claim 4 wherein said shank is screwed onto said stud with a rigid-setting glue applied to the mating threaded portions.

7. The holster and holster-carrying belt of claim 6 wherein a metallic washer is employed around said stud on the outside surface of said inside piece of leather to function as a seat for said shank.

8. The holster and holster-carrying belt of claim 1 wherein said plates are riveted to the inside surface of said belt.

9. A combination of a holster, a holster-carrying belt, and means for rapidly connecting and disconnecting said holster to and from said belt, wherein said means comprises a pair of spaced upstanding pin elements each having a shank and a generally flat head of substantially larger diameter than the diameter of said shank, said means further including a pair of rigid slotted plate elements spaced apart generally the same distance as the distance between said pin elements, each of said plate elements having a slot therein with one end being slightly larger than the diameter of said head and the other end of which has a diameter larger than the diameter of said shank and smaller than the diameter of said head, said slots being oriented with the lengthwise axis of the slot generally parallel to the lengthwise axis of said belt and with the distance between the smaller ends of said slots being less than the distance between the larger ends of said slots, the distance between the smaller ends of said slots being substantially equal to the distance between said pin elements, one said pair of elements being connected to the side of the holster adjacent the body of the wearer and the other pair of elements being connected to the belt.

10. The combination of claim 9 wherein said pin elements are on said holster and said plate elements are on said belt.

11. The combination of claim 9 wherein each said pin element comprises a flat head threaded stud with the threaded portion projecting outwardly toward its respective plate element and with said threaded portion capped with a hollow, internally threaded flat headed shank element.

12. The combination of claim 11 which additionally comprises a rigid setting cement in the mating portions of the threaded stud and the threaded shank element.

13. The combination of claim 11 wherein said holster is made of two matching pieces of leather and said flat head threaded stud is mounted with its flat head between said two pieces of leather and said threaded portion projecting through the piece of leather adjacent to the body of the wearer.

* * * * *